US005317837A

United States Patent [19]

Stähli

[11] Patent Number: 5,317,837

[45] Date of Patent: Jun. 7, 1994

[54] DEVICE ON A DOUBLE DISK LAPPING MACHINE

[76] Inventor: Arthur W. Stähli, Löschgatterweg 16, 2542 Pieterlen, Switzerland

[21] Appl. No.: 849,001

[22] PCT Filed: Feb. 17, 1989

[86] PCT No.: PCT/CH89/00030

§ 371 Date: Dec. 7, 1989

§ 102(e) Date: Dec. 7, 1989

[87] PCT Pub. No.: WO89/09679

PCT Pub. Date: Oct. 19, 1989

[30] Foreign Application Priority Data

Apr. 7, 1988 [CH] Switzerland ..... 1277/88

[51] Int. Cl.[5] ..... B24B 7/00

[52] U.S. Cl. ..... 51/165.77; 51/131.3; 51/165.75; 51/165.76

[58] Field of Search ..... 51/165 R, 165.71, 165.72, 51/165.74, 165.75, 165.76, 165.77, 165.9, 131.2, 131.3, 134.4, 111 R, 117, 118

[56] References Cited

U.S. PATENT DOCUMENTS

| | | | |
|---|---|---|---|
| 1,377,119 | 5/1921 | Eaton | 51/131.4 |
| 1,843,300 | 2/1932 | Player et al. | 51/165.75 |
| 2,603,041 | 7/1952 | Bowen | 51/131.3 |
| 2,840,957 | 7/1958 | Warden | 51/131.4 |
| 3,461,617 | 8/1969 | Wright | 51/131.4 |
| 4,450,652 | 5/1984 | Walsh | 51/131.4 |
| 4,742,651 | 5/1988 | Wittstock | 51/165.9 |
| 4,837,982 | 6/1989 | Berkeley et al. | 51/165.9 |

FOREIGN PATENT DOCUMENTS

| | | | |
|---|---|---|---|
| 35396 | 3/1977 | Japan | 51/131.2 |
| 34266 | 2/1985 | Japan | 51/131.4 |

*Primary Examiner*—Jack Lavinder

*Attorney, Agent, or Firm*—Townsend and Townsend Khourie and Crew

[57] ABSTRACT

Situated on the upper end of a radially pivotable column (3) is a beam (11) arranged essentially at a right angle to it and pivotable approximately in the middle. Situated axially non-sliding on the front beam end (13) is a tool spindle (15) in a spindle head (14) connected to the beam (11) and drivable with a first driving means (17). Fixed to the lower end of the tool spindle (15) via an articulated head (20) is the upper machining disk (21). To bring the machining disk (21) to its working position the column (3), situated and guided in the column guiding housing (2), is designed to be liftable and lowerable via a lifting spindle (4) with a second driving means (6). A first adjusting means (29) connected on the rear beam end (28) serves to keep the beam (11) in an essentially horizontal position. A second adjusting justing means (30) also connected on the rear beam end (28) serves to control the working pressure of the machining disk (21). With the device according to the invention the suspension, the kind of bearing and drive of the machining disk (21) have been constructively resolved in a very simple way as a result of the omission of axial movability of the tool spindle (15). The working pressure of the machining disk (21) can be controlled extremely precisely. Lapping machines with this device are especially suitable for machining wafers, crystals and thin-walled ceramic tiles.

13 Claims, 3 Drawing Sheets

DEVICE ON A DOUBLE DISK LAPPING MACHINE

BACKGROUND OF THE INVENTION

The present invention relates to a device on a double disk lapping machine to bring an upper machining disk into its working position.

Double disk lapping machines have been known for about 40 to 50 years. Pieces to be machined are pulled between the two machining disks by so-called sliding disks with the aid of an inner and outer annulus of vertical pins, and are machined. With double disk lapping machines it is possible to achieve very great parallelism of the machined surfaces of the workpieces. Through the appearance of new technologies, such as the production of silicon disks for integrated circuits, the production of crystals or of the finest ceramic tiles, greater and greater demands have been made of lapping machines. Particularly in the machining of extremely thin-walled materials greatest attention is to be paid to the control of the working pressure of the upper machining disk of double disk lapping machines. Today machines are required in which the upper machining disk is conveyed to the working position as quickly as possible or immediately before the machining disk comes into contact with the surface of the workpiece to be machined. The placing of the upper machining disk on the surface of the workpiece should be done as finely as possible, however, practically without pressure. During machining of the workpieces the working pressure is, depending upon type of utilization, to be continuously controlled according to certain guidelines and to be reduced again at the end of machining in order to lift the machining disk off of the workpiece and to pivot it to the side so that the lapping machine is emptied.

In the design types of double disk lapping machines known today, the upper machining disk in most cases is hung on a motor drivable and axially movable spindle. The spindle is connected to a radially pivotable column of the lapping machine via a bearing component. Via a hydraulic or pneumatic cylinder drive, which connects to said axially movable spindle, the upper machining disk fixed on the lower end of the spindle can be conveyed to, placed upon, and pressed against the workpiece. The cylinder drive first has to compensate the weight of the up to several-thousand-Newton-heavy upper machining disk, bring the machining disk to the workpiece, place it on slowly as already described, and begin with the strain of reduction of weight compensation. On the one hand, since working pressures of some 10,000 Newton are required today, contact pressure conditions result which are hard to control if there is a changeover to an additional strain when removing the weight compensation of the upper machining disk through pressure reversal in the cylinder drive. On the other hand, in the modern-day machines the column tends to tilt with the radially designed upper machining disk as a result of the enormous working pressure. In both cases the precision of the work consequently suffers.

A further embodiment according to the German published application 35 20 713 A 1 tries to circumvent the difficulties mentioned in that the upper machining disk, situated on the lower end of a spindle with an axially movable bearing component, is hung on one end of a two-arm lever while the pneumatically operated adjusting devices are connected on the other end of the lever.

This design is both mechanically and control technically extravagant.

It is the aim of the present invention to create a device on a double disk lapping machine in which said disadvantages of bringing the upper machining disk to, and pressing it against, the surface of the workpiece do not arise. In contrast to the known embodiments of double disk lapping machines, the machine equipped with the device according to the invention is of significantly simpler construction.

The invention fulfills this aim as a result of providing a column which is raisable and lowerable by means of a drivable lifting spindle. A mechanism for maintaining the beam in a substantially horizontal orientation is provided which acts to keep the beam horizontal when the column is lowered. A working pressure adjusting means is also provided between a holder arm, which is firmly connected to the column, and a rear beam end of the beam.

DESCRIPTION OF THE PREFERRED EMBODIMENT

Figure 1:
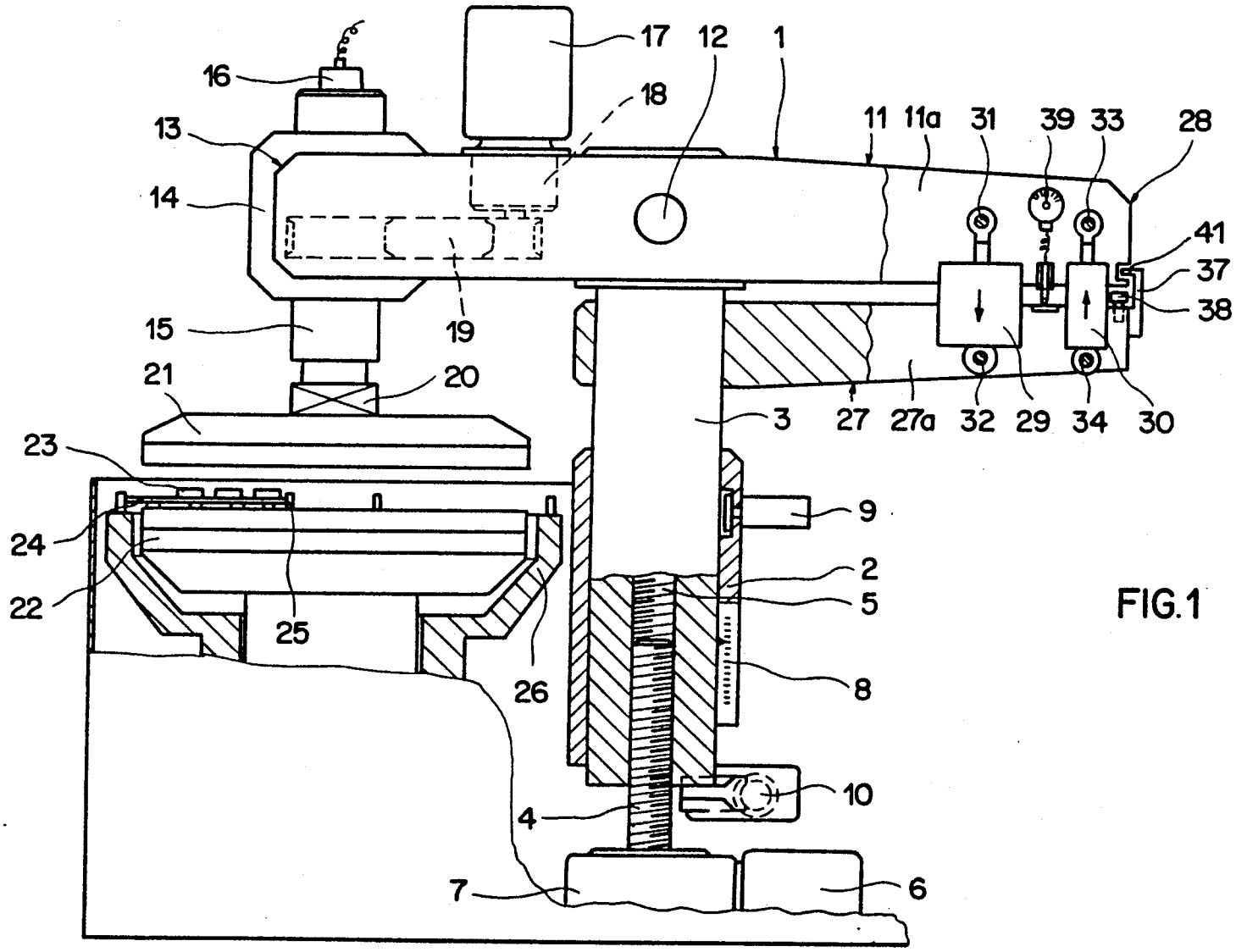
FIG. 1 is a side view is a double disk having machine with partial sectional views.

In the figures listed above a double disk lapping machine is portrayed, care having been taken above all so that the device according to the invention for bringing the upper machining disk into its working position is optimally visible, the other parts of the lapping machine being there only by way of suggestion. The lapping machine comprises a column 3, which is situated and guided in a guide housing 2. Guide housing 2 is rigidly connected to the frame of the machine in a way not depicted. Above on column 3 a beam 11 is arranged essentially at right angles to it and pivotable approximately in the middle. Beam 11 consists of two longitudinal members 11*a*, essentially running parallel to each other, which are connected to each other by means of cross members 11*b* on their rear end 28 and a spindle head 14 on their front end 13. Approximately in the middle, seen in the longitudinal direction of longitudinal members 11*a*, runs a shaft 12, at a right angle to longitudinal members 11*a*, through each of the bore holes made in the latter and in column 3. Beam 11 is pivotably positioned through shaft 12. Spindle head 14, arranged on the front end between longitudinal members 11*a*, holds tool spindle 15. Upper machining disk 21 is fixed flexibly on the lower end of said tool spindle 15 by means of an articulated head 20. An electromotor, for example, is set up, preferably as first driving means 17, on the front beam end behind spindle head 14, and is connected to the latter. Electric molar 17 is equipped with a reducing gear 18 and serves to drive tool spindle 15 by means of a transmitting medium 19, for example a belt drive. On the upper end of tool spindle 15, which preferably displays a longitudinal bore hole, a sensor 16 is mounted through said bore hole. Sensor 16 serves to measure the thickness of the workpiece. It is an intrinsic feature of the present invention that tool spindle 15 is situated in the spindle head without the possibility of axial displacement.

Column 3 displays in its upper area a holder arm 27 pointing back and running essentially parallel to beam 11. Holder arm 27 comprises two supports 27*a*, spaced apart, running parallel to each other, connected essentially tangentially to column 3. On rear end 28 of beam 11 between longitudinal members 11*a* a first adjusting means 29 is connected pivotably to beam 11 via a first pivot pin 31. First adjusting means 29, which preferably comprises a pneumatic or hydraulic cylinder drive, is connected on its other side to holder arm 27 via a second pivot pin 32 between supports 27*a*. First adjusting means 29 has the task of compensating the weight of upper machining disk 21 of up to several thousand Newton and of keeping beam 11 in an essentially horizontal position. A second adjusting means 30, which also consists preferably of a pneumatic or hydraulic cylinder drive, is connected, as described, via a third pivot pin 33 with rear beam end 28 of beam 11 and via a fourth pivot pin 34 with the holder arm 27. This cylinder drive serves to control the working pressure of upper machining disk 21.

A path limiting device 37, 38, 41 arranged on rear end 28 of beam 11 has the task of limiting the pivoting movement of beam 11. Construction is so designed that said pivoting movement of beam 11 amounts to at most 20 mm at the front end. The path limiting device consists of a groove 41 worked into a cross member 11*b* of beam 11 at rear beam end 28. A catch element of hook-shape design 37, which is adjustably connected to holder arm 27, meshes into said groove 41 to limit the pivoting movement of beam 11. The pivoting movement of beam 11 can be stopped additionally with an adjustable limit stop 38 arranged in holder arm 27.

Column 3 displays on its lower end a concentrically arranged bore hole 5 provided with an internal screw thread. A lifting spindle 4, drivable by means of an elective motor 6, for example, as the second driving means, via a gearing 7, meshes into the screw thread of bore hole 5 to lift and lower column 3. Motor 6 with gearing 7 and lifting spindle 4 are connected to the frame of the lapping machine. A further intrinsic feature of the device according to the invention consists in the existence of a functional separation between bringing machining disk 21 into its working position and controlling the working pressure of machining disk 21 on the surface of workpiece 23. The bringing takes place through the lowering movement of column 3 by means of lifting spindle 4, and controlling the working pressure occurs through applying a displacement force to beam 11 via the second cylinder drive 30.

A first measuring means 8, which is arranged on guide housing 2, permits measurement of the vertical position of column 3. With a second measuring means 39 the pivoting movement and thereby the turning out of beam 11 are measurable. First and second measuring means 8, 39 as well as sensor 16 to measure the thickness of the workpiece are linked to a non-depicted control mechanism of the lapping machine. The control mechanism handles the signals received from measuring means 8, 39 and from sensor 16 to control lifting spindle 4 and cylinder drive 29, 30.

For simple loading and unloading of the lapping machine, the lower end of column 3 is flanged to a swivel cylinder 10.

Figure 2:
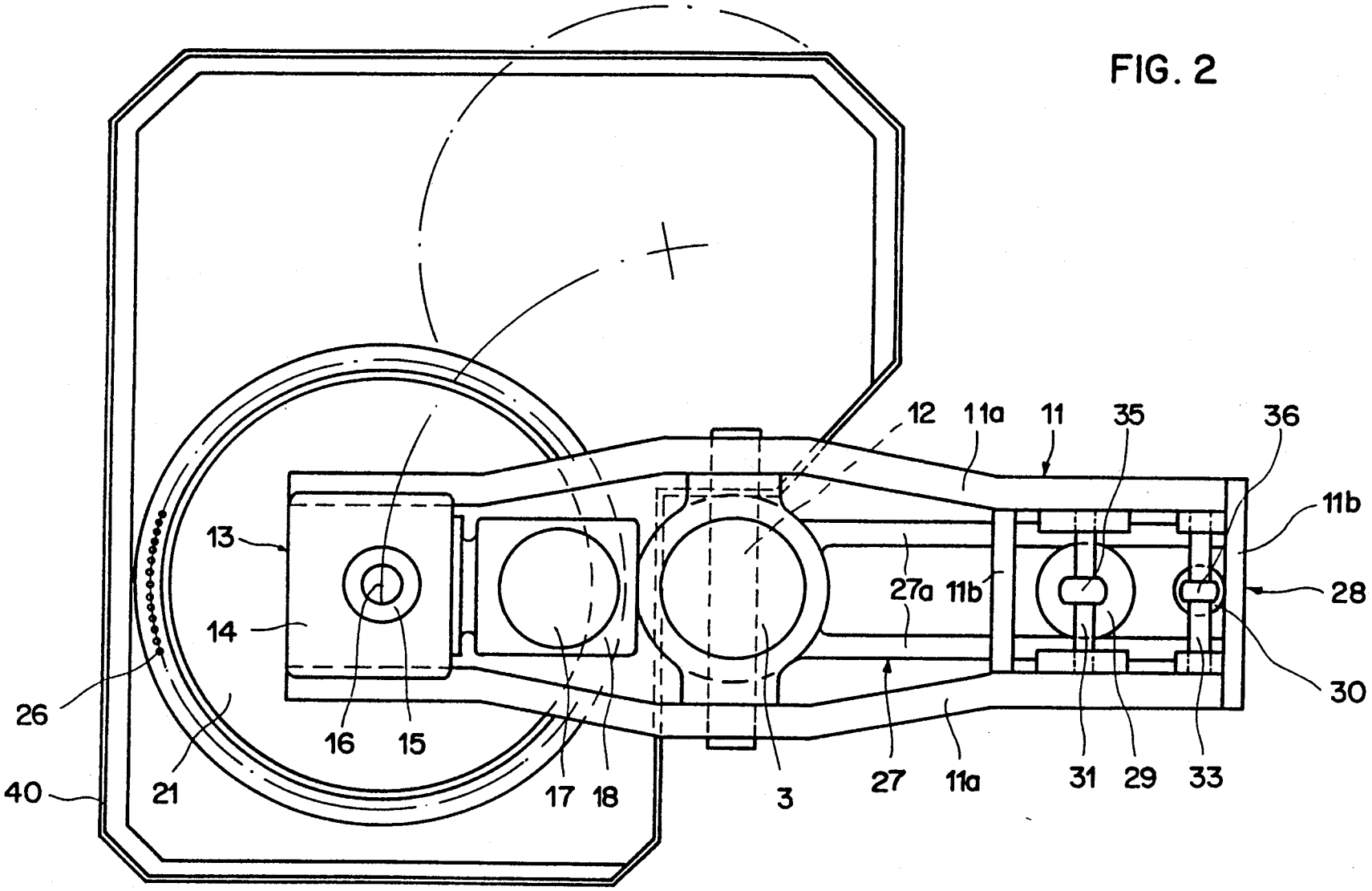
FIG. 2 is a plan view.
Figure 3:
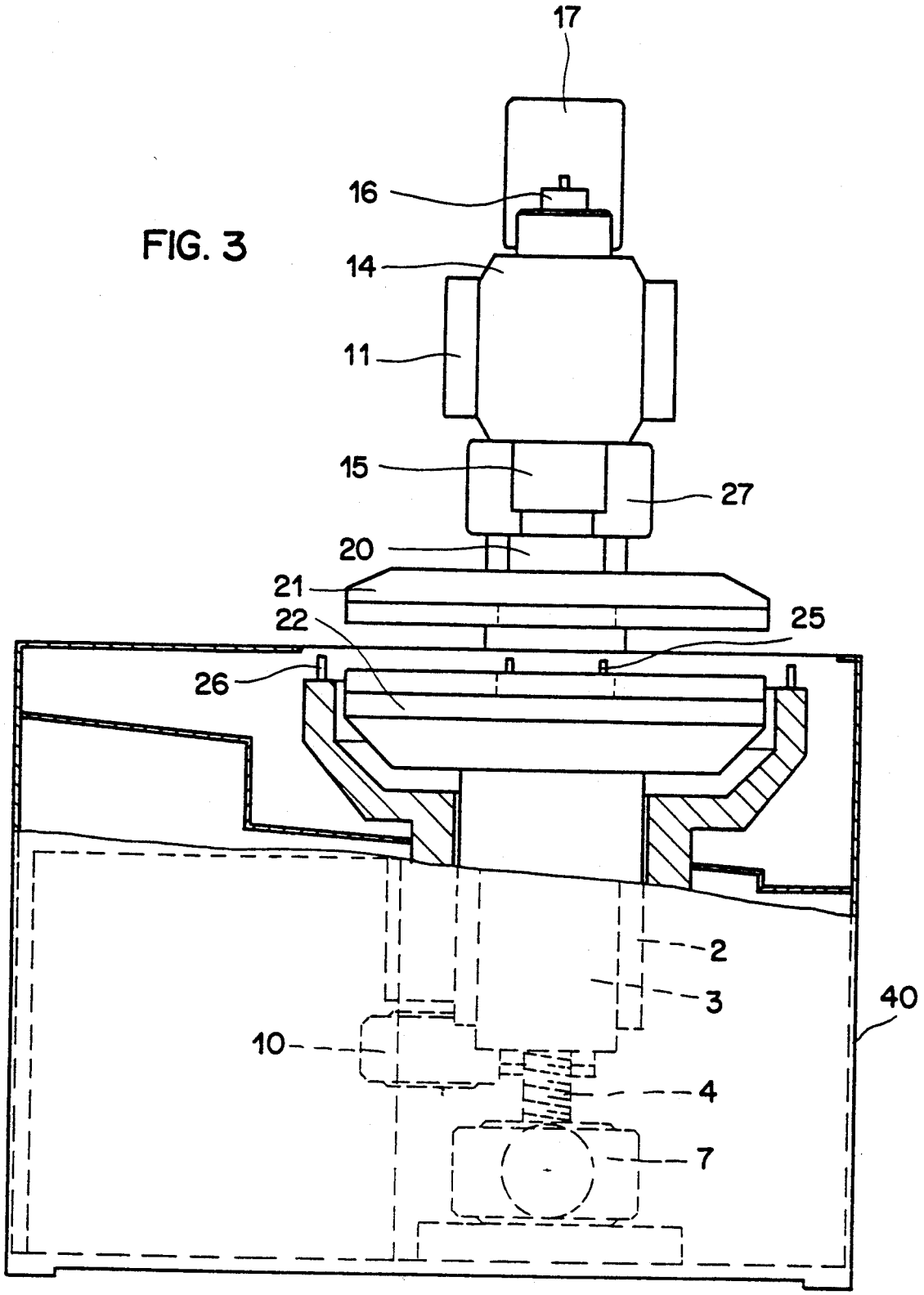
FIG. 3 is a front view of the double disk lapping machine according to the invention.

Cylinder 10 serves to swivel out column 3 with relation to upper machining disk 21. In FIG. 2 the swiveled out position is depicted. To secure a vertical position of column 3 set by lifting spindle 4, column 3 is stoppable by means of a clamp cylinder 9.

So that upper machining disk 21 always has a position parallel to lower machining disk 22, pivoting movement of beam 11, the upper machining disk is connected to the lower end of the tool spindle via an articulated head 20. Considering the only very small swiveling movements of beam 11, the thereby resultant side shift of upper machining disk 21 in relation to lower machining disk 22 is negligible.

A lapping operation with the device on a double disk lapping machine according to the invention is described in the following. Column 3 is in a raised position, and upper machining disk 21 is in the swiveled out position. Workpieces 23 to be machined are placed in the receiving holes of sliding disk 24 on the surface of lower machining disk 22 . With swivel cylinder 10 upper machining disk 21, which is in the swiveled out position, is swiveled in. The swiveled in position is limited, for example, by a non-depicted limit stop in such a way that the two machining disks 21 and 22 lie centrally one over the other. The thickness of the unmachined workpieces plus a tolerance of preferably 0.2 mm is fed into the non-depicted control mechanism as the feed measurement. Via lifting spindle 4, rapid lowering of upper machining disk 21 takes place in the direction of the surface of workpieces 23. The control mechanism monitors the signal from first measuring means 8 and ensures that the lowering movement of column 3 stops in time, shortly before upper machining disk 21 comes into contact with the surface of workpieces 23. At the same time first cylinder drive 29 keeps beam 11 continuously in a horizontal position. A small force, directed upwards, is introduced with second cylinder drive 30. By this means upper machining disk 21 lowers itself slowly, and without any working pressure worth mentioning, onto the surface of workpieces 23. With the help of lower machining disk 22, previously set in rotation, the inner annulus of vertical pins 25 and/or the outer annulus of vertical pins 26 plus upper machining disk 21 the lapping process can begin by means of elective motor 17. With the aid of a timing program, which is stored, for example, in the non-depicted control mechanism of the lapping machine, the lapping operation starts to run; the control mechanism continuously monitors the workpiece thickness, based on the signal supplied by sensor 16, and controls the working pressure of mac 21 via second cylinder drive 30 on the basis of the program put in, which depends upon the workpiece to be machined. During the operation the vertical position of column 3 is secured by clamp cylinder 9. At the end of the lapping operation the working pressure of upper machining disk 21 is reduced, and beam 11 is brought into the horizontal position by weans of first cylinder drive 29. The rotational movements of machining disks 21, 22, the annulus of vertical pins 25 and/or 26 are switched off. After release of clamp cylinder 9, column 3 is lifted through activation of lifting spindle 4. With swivel cylinder 10 upper machining disk 21 is brought into the swiveled out position again. The lapping machine can be unloaded and can be filled with new workpieces 23 to be machined.

The double disk lapping machine equipped with the device according to the invention displays the following additional, advantageous features:

Through functional separation of the bringing of upper machining disk 21 into its working position with lifting spindle 4 and the control of the working pressure with second cylinder drive 30 via beam 11, it is no longer necessary to design tool spindle 15 of the upper machining disk or its bearing component to be axially slidable. Thus the kind of bearing, the sealing against oil and the drive of the upper machining disk are significantly simplified and made considerably less expensive. Construction of the upper tool spindle is shortened, and the realization of measuring sensor 16 and the cooling lines through the hollow spindle are simplified.

By means of the two cylinder drives 29, 30 an exact control of the working pressure of upper machining disk 21 can be achieved since the otherwise commonly used sliding cylinder is omitted with its well-known disadvantageous slip-stik and the pressure reversal which takes place during the work cycle.

A cause of accidents which has existed until now is practically excluded since an undesired lowering of upper machining disk 21 by lifting spindle 4 is no longer possible.

Through application of the balance beam principle, column 3 is stressed relatively little. The tilting of the column, known from other types of design of double disk lapping machines, is thereby avoided.

I claim:

1. A double-disk lapping machine, comprising:

a column;

a beam pivotally coupled to the column, the beam having a front beam end and a rear beam end;

a spindle head rigidly fixed to the front end of the beam;

a tool spindle at least partially housed within the spindle head;

an upper machining disk supported by the beam at the front beam end, the upper machining disk being drivingly coupled to the tool spindle;

a lifting spindle configured to raise and lower the column;

means for driving the lifting spindle;

means for maintaining the beam in a substantially constant angular orientation with respect to the column when the lifting spindle lowers the column; and means for adjusting a working pressure of the upper machining disk.

2. The double-disk lapping machine according to claim 1, wherein:

the adjusting and maintaining means are pneumatically or hydraulically operable.

3. The double-disk lapping machine according to claim 1, further comprising:

a path limiting device configured to limit a pivotal movement of the beam.

4. The double-disk lapping machine according to claim 3, wherein:

the path limiting device limits the pivotal movement of the beam to at most 20 mm at the front beam end.

5. The double-disk lapping machining according to claim 1, wherein:

the first driving means is arranged on the front beam end and connected to the tool spindle via a reducing gear and a transmitting medium.

6. The double-disk lapping machined according to claim 1, wherein:

the upper machining disk is supported on a lower end of the tool spindle.

7. The double-disk lapping machine according to claim 1, further comprising:

means for measuring the vertical position of the column.

8. The double-disk lapping machine according to claim 1, further comprising:

means for measuring the pivotal movement of the beam.

9. The double-disk lapping machine of claim 1, wherein:

the substantially constant angular orientation comprises a substantially horizontal position of the beam.

10. The double-disk lapping machine of claim 1 wherein:

the beam is pivotally coupled to the column at a pivot point; and the maintaining and adjusting means act on the beam at differing distances from the pivot point.

11. The double-disk lapping machine of claim 1 further comprising:

a holder arm fixed to the column; and the adjusting means being connected to the holder arm.

12. The double-disk lapping machine, comprising:

a column;

a beam pivotally coupled to the column, the beam having a front beam end and a rear beam end;

a tool spindle;

means for coupling the tool spindle to the beam so that an angular orientation therebetween is substantially the same when the beam is pivoted about the column;

an upper machining disk supported by the beam at the front beam end, the upper machining disk being drivingly coupled to the tool spindle;

a lifting spindle configured to raise and lower the column;

means for maintaining the beam in a substantially constant angular orientation with respect to the column when the lifting spindle lowers the column; and means for adjusting a working pressure of the upper machining disk.

13. The double-disk lapping machine, comprising:

a column;

a lifting spindle configured to raise and lower the column;

means for driving the lifting spindle;

a beam pivotally coupled to the column, the beam being pivotally coupled to the column at approximately a midpoint of the beam, the beam having a front beam end and a rear beam end;

a spindle head rigidly connected to the front beam end of the beam;

a tool spindle having a longitudinal axis and being at least partially housed within the spindle head, the tool spindle being fixed within the spindle head with respect to movement in a direction of the longitudinal axis;

means for driving the tool spindle;

an upper machining disk supported by the beam at the front beam end, the upper machining disk being drivingly coupled to the tool spindle;

means for maintaining the beam in a substantially horizontal position;

a holder arm fixed to the column; and means for adjusting a working pressure of the upper machining disk, the adjusting means being connected to the holder arm.

* * * * *